United States Patent [19]

Fukuoka

[11] Patent Number: 4,979,317

[45] Date of Patent: Dec. 25, 1990

[54] VENTILATED SYNTHETIC RESIN SHOE

[76] Inventor: Tatsuo Fukuoka, 3-3, Shinminamifukushima 2-Chome, Tokushima-Shi, Tokushima, Japan, 770

[21] Appl. No.: 409,863

[22] Filed: Sep. 7, 1989

[51] Int. Cl.[5] ..... A43B 7/06

[52] U.S. Cl. ..... 36/3.00 A; 36/3.99 R

[58] Field of Search ..... 36/3 R, 3 A, 45

[56] References Cited

U.S. PATENT DOCUMENTS

| | | | |
|---|---|---|---|
| 911,740 | 2/1909 | Montgomery | 36/3 A |
| 1,168,166 | 1/1916 | Cook | 36/3 A |
| 3,310,887 | 3/1967 | Stokis | 36/3 R |
| 4,771,555 | 9/1988 | Ohashi | 36/3 A X |

FOREIGN PATENT DOCUMENTS

| | | | |
|---|---|---|---|
| 7339 | of 1905 | United Kingdom | 36/3 A |
| 8446 | of 1905 | United Kingdom | 36/3 A |

*Primary Examiner*—Paul T. Sewell
*Assistant Examiner*—Andrew D. Meyers
*Attorney, Agent, or Firm*—Wenderoth, Lind & Ponack

[57] ABSTRACT

A shoe with a synthetic resin shell that is easily and inexpensively mass produced, and which is both water proof and provides ventilation included a number of ventilation holes in the shell. The size of the ventilating holes are such that surfaces tension forces prevent water from entering the shoe through the ventilation holes.

2 Claims, 4 Drawing Sheets

FIG. 4
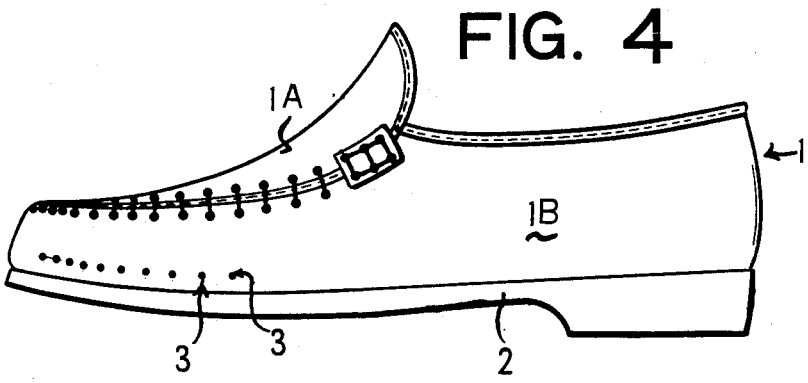
FIG. 5
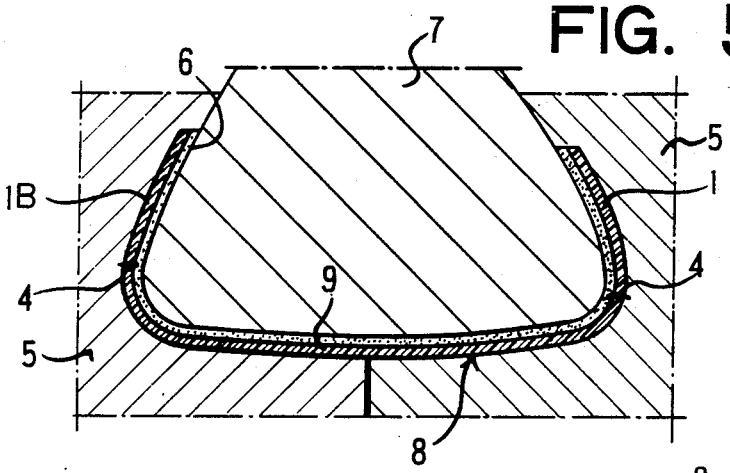
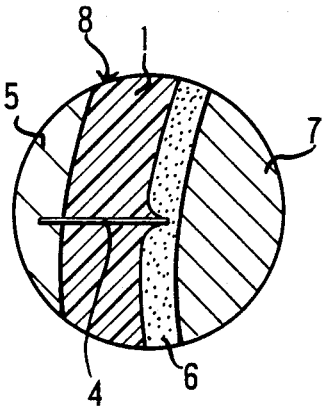
FIG. 6
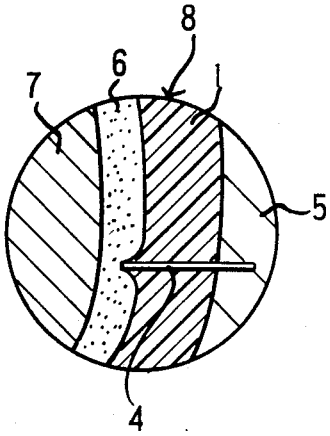
FIG. 7

VENTILATED SYNTHETIC RESIN SHOE

BACKGROUND OF THE INVENTION

This invention relates to a synthetic resin shell shoe that can be easily and inexpensively mass produced. More specifically, the shell has ventilation for inhibiting dampness and heating as well as protection to prevent the intrusion of water into the shoe.

Because of the beauty and ventilation provided by natural leather, it is often used for the shell of high quality shoes. However, as well as providing ventilation, water can permeate through natural leather by capillary attraction. Therefore, natural leather has the disadvantage that the shoe becomes wet in rainy weather. Further, because leather, originally in sheet form, must be formed, with the midsole attached beneath, into a three dimensional surface in the shape of the foot, it also has the drawbacks that manufacture requires extensive labor, advanced techniques, and is a costly process. Still further drawbacks are loss of shape resulting from forming an inherently two dimensional sheet material into a three dimensional shape, and difficulty in producing shoes with wearing comfort similar to that of athletic shoes because of leather's inability to stretch sufficiently.

The inventor has developed a shoe with a shell partially formed from synthetic resin to solve the problems associated with natural leather (Japanese Public Disclosure No. 38241/1982).

The shoe of the present invention has the following features. Because the shell is molded as a three dimensional surface following the contour of the foot, it can be mass produced inexpensively compared with a natural leather shell. Because the shell form fits the surface of the foot and is stretchable, local regions of the shell do not get over stressed and the shoe can easily be worn for long periods with comfort. Further, because the three dimensional shape is formed with a mold, the shoe does not lose its shape.

Moreover, by galvanically etching the inner surface of the shell mold, a three dimensional pattern resembling that of natural leather can be imprinted on the surface of the synthetic resin shell. Consequently, a synthetic resin shell shoe with a handsomely patterned outer surface indistinguishable from that of high quality natural leather can be produced.

However, the principal and only drawback of a synthetic resin shell shoe is the lack of the important factor, ventilation. Consequently, if a synthetic resin shoe with the ventilating properties of natural leather or cloth were possible, an essentially ideal shoe could be produced.

Ventilation can be provided to a synthetic resin shell by forming a mesh pattern or large holes through the shell. However, like the former leather shoe, a shell with this configuration allows water to enter the shoe as well as air, and has the drawback that the foot gets wet when the shoe is worn in rainy weather. An all weather shoe cannot be realized in this fashion.

Over a period of many years of various experimentation and trial and error utilizing novel material properties, the inventor has tried to develop a synthetic resin shell having the apparent contradicting properties of ventilation and water protection. A synthetic resin shell has an extremely different structure from the dense collection of numerous fibers constituting natural leather, and consequently the inside of the synthetic resin shell does not absorb water by capillary action. Specifically, the synthetic resin shell is formed by injecting molten synthetic resin into a mold of the designated shape, and the shell formed by this process is essentially filled without gaps or holes with synthetic resin. It is well known that a shell with this structure does not allow either water or air to pass through it, does not absorb water, and has the unique property of repelling water.

By effective application of a unique physical property, namely surface tension, which is also responsible for the capillary action that causes water absorption by natural leather, the inventor has succeeded in developing a synthetic resin shell providing sufficient ventilation while effectively preventing water from permeating the ventilation holes into the shoe.

SUMMARY OF THE INVENTION

It is accordingly a primary object of the present invention to provide an all weather synthetic resin shoe with a shell having exceptional ventilation as well as water resistance, and which can be worn comfortably without getting damp in rainy weather.

Another important object of the present invention is to provide a synthetic resin shoe with ventilation at the front of the foot that effectively prevents dampness and heating, and which can be easily and inexpensively mass produced.

In the shoe of this invention, the major part of the shell 1 including the part at the front of the foot is formed from synthetic resin. A plurality of ventilation holes 3 are provided along the bottom edge of the part of the shell 1 at the front of the foot. Moreover, the diameter D (mm) of the ventilation holes 3 satisfy the following three conditions.

For a shell 1 thickness W (mm) in the region where the ventilation holes 3 are opened and a height H (mm) from the ventilation holes 3 to the lowest part of the shoe opening 10, the diameter D (mm) of the ventilation holes 3 must satisfy:

(a) $D < 30.2/H$ (b) $D \leqq W$ (c) $D \leqq 1.5$

Further, in the shoe of this invention, it is preferable to have a water repellent liner 6 inserted against the inside surface of the shell 1 to prevent the intrusion of any water through the ventilation holes 3.

The shoe of this invention has a synthetic resin shell 1 which effectively utilizes the unique material properties of water repellency and surface tension to prevent the intrusion of water through the ventilation holes 3.

In other words, as illustrated in FIG. 1, if water can be prevented from permeating through the ventilation holes 3 when the shoe is worn in the deepest puddle where the water surface is near the shoe opening 10 in the shell 1, then as long as water does not flow into the shoe opening 10, it will not flow in through the ventilation holes 3.

With the situation shown in FIG. 1, water enters the ventilation holes 3 with the highest pressure The water pressure applied to the ventilation holes 3 is proportional to the depth of the ventilation holes 3 beneath the water. Consequently, the water depth and the pressure acting on the ventilation holes 3 can be reduced by locating the ventilation holes 3 at the upper part of the shell 1. However, because the bottom part of a shoe with a synthetic resin shell 1 is the most likely to become hot and damp, a well ventilated shoe cannot be made without locating the ventilation holes 3 at the bottom edge of the shell 1.

Although water pressure proportional to water depth acts on the ventilation holes 3 at the bottom edge of the shell 1, the intrusion of water with this head through the ventilation holes 3 is prevented by the water's surface tension within the ventilation holes 3.

Turning to FIG. 2, water entering a ventilation hole 3 takes on a hemispherical shape due to the water repellent action of the synthetic resin, and the surface tension forces T act in directions preventing water intrusion into the shoe. When the force F resulting from the surface tension forces T is greater than the pressure force f of the water entering the ventilation hole 3, water is prevented from entering the shoe.

When the surface tension force of water in opposition to air is T (dyne/cm) and the radius of the ventilation hole 3 is r (cm), the resulting force due to surface tension preventing water intrusion into the shoe F is given by the product of the ventilation hole circumference ($2\times\pi\times r$ cm) and the surface tension force T (dyne/cm), or $$F=T\times 2\times\pi\times r \text{ (dyne)} \quad (1)$$

Further, when the water depth or head is h (cm), the pressure force f (dyne) of the water tending to flow into the ventilation hole 3 is the product of the cross sectional area of the ventilation hole 3 ($\pi\times r^2$ cm$^2$) times the water pressure (dyne/cm$^2$), or $$f=\pi\times r^2\, h\times g\times\rho \text{(dyne)} \quad (2)$$

where g is the acceleration of gravity 980 cm/sec$^2$, and $\rho$ is the water density 1 g/cm$^3$.

When the condition $F>f$ is satisfied, the intrusion of water through the ventilation hole 3 is prevented. The water surface tension force T varies slightly with temperature, but at 15° C. it is 73.48 dyne/cm. Taking the surface tension force T to be 74 dyne/cm and applying equations (1) and (2), the pressure force of the water tending to flow into the ventilation hole is weaker than the opposing force resulting from the surface tension T if the equation $$r<0.151/h$$

is satisfied.

Converting from cm to mm, when the ventilation hole 3 diameter is D (mm) and the height of the water above the ventilation hole 3 region is H (mm), then $D=2\times r\times 10$, $H=10\times h$, and $$D<30.2/H$$

FIG. 3 shows a graph of water depth versus ventilation hole 3 diameter when the pressure force f of the water tending to enter the ventilation hole 3 is balanced by the resulting force F due to surface tension T preventing water from entering.

It is clear from this graph that for 1 mm diameter ventilation holes 3, water up to 30 mm deep can be prevented from entering the shoe through the ventilation holes 3.

As stated previously, for the situation shown in FIG. 1, the greatest pressure acts on the ventilation holes 3 when they are located at the bottom edge of the shell 1. In other words, the greatest water pressure acts on the ventilation holes 3 when the water level is positioned at the shoe opening 10 or, for example, when the shoe is worn in the deepest puddle in which water does not flow into the shell 1 through the shoe opening 10. This water depth corresponds to the height H from the ventilation holes 3 to the shoe opening 10 in the shell 1. Therefore, for a shoe with a height of 30 mm from the ventilation holes 3 to the shoe opening 10 in the shell 1, surface tension can be utilized to prevent water from entering the shoe through the ventilation holes 3 if the ventilation holes 3 are made less than or equal to 1 mm in diameter.

If the hemispherical front of water within a ventilation hole 3, shown in FIG. 2, projects beyond the inside surface of the shell 1, it will contact the shell liner 6 or the sock, and water intrusion will not be prevented. Since the shoe of this invention has a ventilation hole 3 diameter D smaller than the shell 1 thickness W, the hemispherical front of water within a ventilation hole 3 cannot project beyond the inner surface of the shell 1, and therefore, the intrusion of water into the shell 1 can be prevented.

The inside diameter of the ventilation holes 3 is further restricted to less than or equal to 1.5 mm. Ventilation holes 3 with a diameter of 1.5 mm can prevent water intrusion at depths up to approximately 20 mm. Although the ventilation holes 3 are opened at the bottom edge of the shell 1, they are still usually 10 mm or more above the bottom of the shoe sole. Consequently, a shoe with 1.5 mm ventilation holes 3 located 1 cm above the bottom of the sole can prevent water intrusion when worn in a 30 mm deep puddle.

A puddle less than or equal to 30 mm deep has the characteristic that even when the shoe is vigorously plunged into the puddle and the ventilation holes 3 receive the impact of the water, water intrusion can be prevented.

Consequently, because the shoe of this invention has a plurality of ventilation holes opened at the bottom edge of the shell, it has the following characteristics. It has a synthetic resin shell that provides ventilation. Optimum comfort during wear is achieved by freely adjusting the number and size of the ventilation holes to provide ventilation to the most likely part of the shoe most likely to get hot and damp. Further the shoe is an all weather shoe that can be worn in comfort even in rainy weather because water is prevented from entering the shoe even though sufficient ventilation is provided.

More specifically, surface tension responsible for capillary action which results in water intrusion through the gaps between fibers in a natural leather shoe shell, has been used to its advantage, along with the water repellent property of a synthetic resin shell, to realize the shoe of this invention with a synthetic resin shell having the extremely important feature that water intrusion is prevented.

Furthermore, although the shoe of this invention is provided with ventilation for comfort, the shell is formed from synthetic resin, and therefore, has the feature that it can be simply, easily, and inexpensively mass produced.

BRIEF DESCRIPTION OF THE DRAWINGS

FIG. 4 is side view showing a preferred embodiment of the shoe of this invention;

FIG. 5 is a cross sectional view showing the mold ready for formation of the shell 1 and the midsole 9;

FIG. 6 and FIG. 7 are enlarged cross sectional views showing important parts of FIG. 5.

DESCRIPTION OF THE PREFERRED EMBODIMENT

Implementation of a preferred embodiment of the present invention is described with reference to the drawings. However, this implementation serves only as a concrete example illustrating the technology embodied in the shoes of the present invention, and the shoes of this invention are in no way limited to the following embodiment. The shoes of the present invention may have various additional changes within the limits described in the appended claims.

Figure 1:
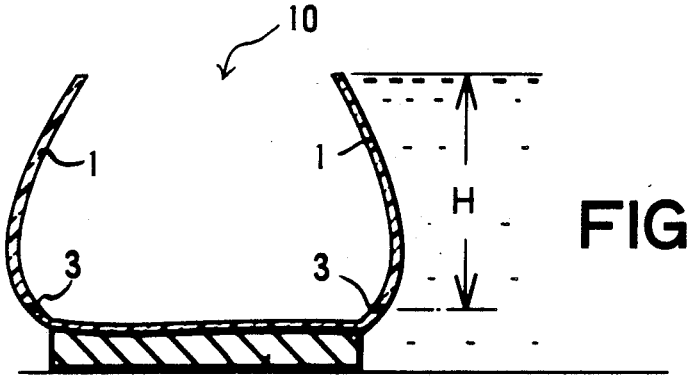
FIG. 1 is a cross sectional view showing a preferred embodiment of the shoe of this invention emersed in a puddle of water.
Figure 2:
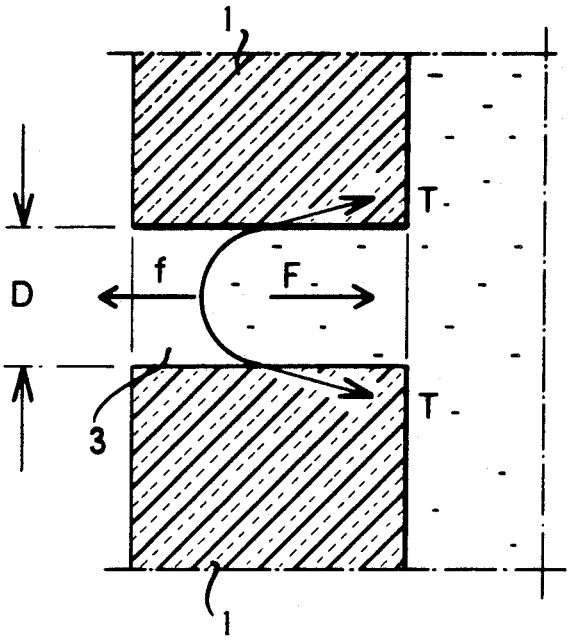
FIG. 2 is a cross sectional view showing water intrusion into the ventilation hole 3 region of the shoe.

The shoe shown in FIG. 1 is formed from synthetic resin as a single piece having a midsole 9 and a shell base 1B, which comprises one part of the shell 1. Ventilation holes 3 are provided along the bottom edge of a front part of the shell base 1B.

The shell base 1B and the midsole 9 are curved planes in three dimensions following the contour of the foot, and are formed from a pliable synthetic resin such as polyvinyl chloride, polyurethane, or a mixture of such resins.

The shell base 1B is formed from synthetic resin, a shell vamp 1A is sewn to the shell base 1B, and then a sole 2 is attached. Otherwise, the sole 2 is attached to the bottom of the midsole 9 after the shell 1 and midsole 9 are formed.

By restricting the diameter D (mm) of the ventilation holes 3 in the shell 1 to satisfy the following three conditions, surface tension can be utilized to make the shoe waterproof.

Namely, for a shoe with the ventilated region of the shell 1 having a thickness W (mm) and with the lowest part of the shoe opening 10 having a height H (mm) above the ventilation holes 3, the following conditions must be satisfied. The diameter D (mm) of the ventilation holes 3 must be formed less than or equal to the thickness of the ventilated region of the shell 1, or $D \leqq W$, also $D \leqq 1.5$, and further, the diameter D (mm) must be less than a constant determined by the water surface tension and density (30.2) divided by height H (mm) of the lowest part of the shoe opening 10 above the ventilation holes 3, or $D < 30.2/H$.

For purposes of this specification, the shoe opening of the shell 1 is taken to mean the region of the shell that is open enough to allow water to flow into the shoe. For the case where the entire shell 1 is formed as a single piece from synthetic resin, the shoe opening is the opening through which the foot is inserted. However, for the shoe shown in FIG. 4, where the shell vamp 1A is sewn to the shell base 1B, the shoe opening includes the region of the shell vamp 1A and the sewing holes. Further, the height H between the ventilation holes 3 and the shoe opening 10 is taken to mean the height between the ventilation holes 3 and the lowest part of the shoe opening when the shoe is horizontally disposed.

For the stationary case, the intrusion of water into the shoe is prevented by restricting the diameter D (mm) of the ventilation holes 3 to $D < 30.2/H$. However, in actual use, the shoe may be worn by someone who may vigorously walk into a puddle. Therefore, for effective water protection, it is desirable for the ventilation holes 3 to be designed smaller than the maximum value given above.

Figure 3:
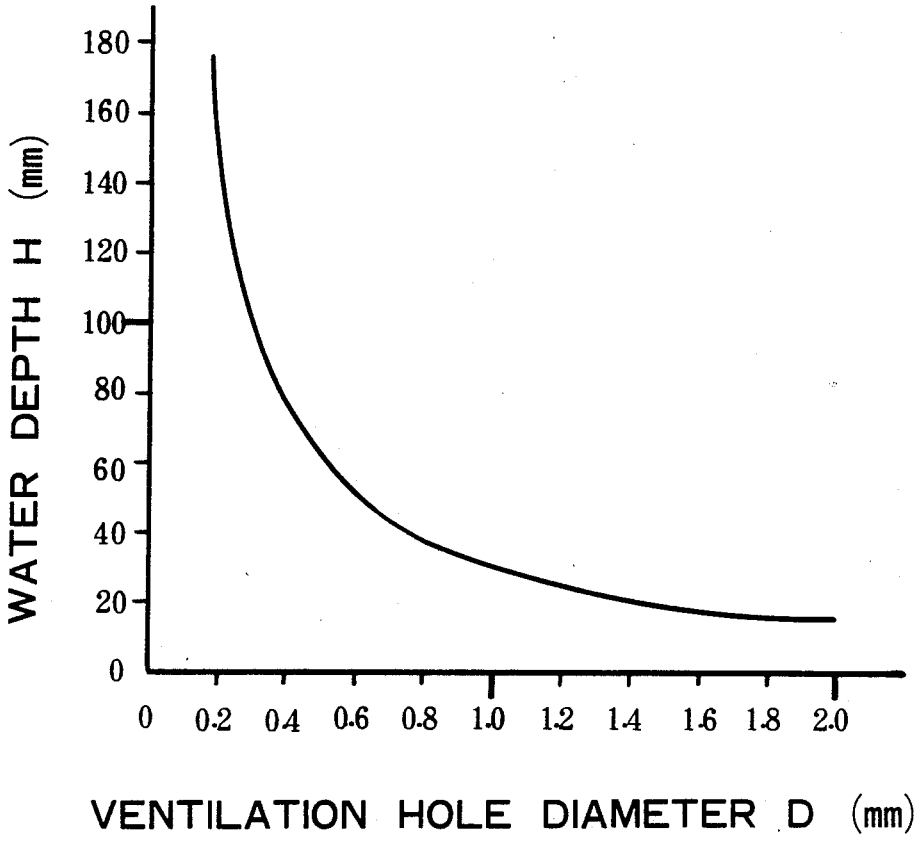
FIG. 3 is a graph showing the relation of the maximum water depth to the diameter of the ventilation holes 3.

For example, when the height H of the shoe opening 10 in the shell 1 above the ventilation holes 3 is 30 mm, the diameter of the ventilation holes 3 is determined to be 1 mm by the graph of FIG. 3. However, it is preferable to design the ventilation holes 3 with a diameter of 0.6 mm or less to prevent water intrusion from a 50 mm head.

In other words it is preferable to make the diameter of the ventilation holes 3 less than or equal to $(30.2/H) \times 0.6$ for more effective water protection.

As shown in FIG. 5 and the magnified drawings of FIG. 6 and FIG. 7, the mold for forming the shell base 1B with ventilation holes 3 utilizes a female casing 5 provided with needle projections 4 into the shell mold 8 to create the ventilation holes 3 in the shell 1. Further, before the mold is closed, a cushioned liner 6 for the shell 1 is attached to the mold center piece 7, and as shown in FIG. 6 and FIG. 7, the tips of the needle projections 4 which apply pressure to the resilient liner 6 are supported by the liner 6. In this state, pressurized molten synthetic resin is injected into the mold 8 to form the shell base 1B.

When the mold is closed and ready for injection, the tips of the needle projections 4 apply pressure against the liner 6 to sandwich the liner 6 between the needle projections 4 and the mold center piece 7 preventing synthetic resin from entering that region. Consequently, the length of the needle projections 4 is somewhat less than the length required to contact the surface of the mold center piece 7. Specifically, the needle projections 4 are shorter than the length required to contact the mold center piece 7 by an amount equal to the thickness of the liner 6 when it is compressed. The compressed thickness of the liner 6 depends upon the liner material, the liner thickness, and the applied pressure. When the liner 6 is made of continuously frothed synthetic resin foam sheet with thin cloth attached and the uncompressed thickness is 1.5 to 3.5 mm, the completely compressed thickness is normally 0.1 to 1 mm. Consequently, the length of the needle projections 4 is made 0.1 to 1 mm shorter than the length required to contact the surface of mold center piece 7.

However, when the needle projections 4 are extremely thin as shown in FIG. 6, the tips of the needle projections 4 pierce into the liner 6 when the mold is closed ready for injection. In this case, the length of the needle projections 4 can be made longer than the length required to contact the mold center piece 7 minus the thickness of the liner 6 in the compressed state. Consequently, extremely thin needle projections 4 can be made essentially equal to the length required to contact the mold center piece 7 or, for example, 0.03 to 0.5 mm shorter than the length required to contact the mold center piece 7.

When the mold is closed and the needle projections 4 pierce into the liner 6, the needle projections 4 are reliably supported by the liner 6 and bending or breaking is effectively prevented during injection of the molten synthetic resin.

When the tips of the needle projections 4 pierce the back side of the liner 6 by applying pressure to the liner cloth, the needle projections 4 should be narrower than the weave of the cloth. When the tips of the needle projections 4 pierce the front side of the liner 6 by applying pressure to the synthetic resin foam layer, the needle projections 4 should be either about the same size or narrower than the diameter of the foam bubble size.

The size of the ventilation holes 3 in the shell 1 are determined by thickness of the needle projections 4.

The smaller the ventilation holes 3 formed in the shell 1 by the needle projections 4, the less they stand out. However, even when the ventilation holes 3 are somewhat large, they can be hidden by a pattern designed on the outer surface of the shell 1. For example, the ventilation holes 3 can be made difficult to see with a rough shell surface resembling natural leather or other indentation patterns on the shell.

Figure 8:
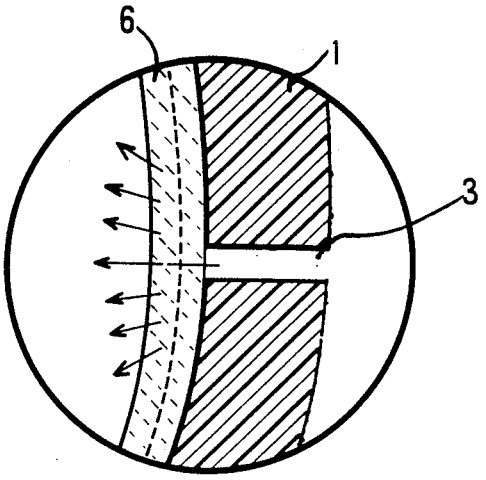
FIG. 8 is an enlarged cross sectional view showing the resilient deformability and ventilation provided by the liner on the inside surface of the shell.

The water repellent, ventilating liner 6 is provided on the inside of the shell 1. Since water is repelled off the water repellent liner 6, the intrusion of water is more effectively prevented by the liner 6. Further, when used for walking, the foot applies pressure to compress the liner 6 to the broken line shown in FIG. 8, thereby creating forced ventilation. Still further, the liner 6 prevents the foot from directly contacting and blocking off the ventilation holes 3, and as shown by the arrows of FIG. 8, the liner 6 more effectively distributes air from the ventilation holes 3 over a wide area.

The number of ventilation holes 3 in the shell 1 is determined considering the size of the ventilation holes 3 and the ventilation required. The larger the ventilation holes 3, the better the ventilation and the fewer the number of holes required. When the diameter of the ventilation holes 3 is 0.2 to 0.6 mm and the holes are opened through the front part of the shoe shown in FIG. 1, the number of holes through one side of the shell base 1B is in the range of 5 to 100, and desirably in the range of 7 to 30.

The needle projections 4 for opening the ventilation holes 3 are made of metal wire, such as piano wire, with sufficient strength to prevent deformation during the injection of synthetic resin into the mold 8. The needle projections 4 are inserted into, and fixed in holes made in the female casing 5 with a laser beam or small drill.

When the mold is closed ready for injection, the liner 6 is sandwiched between the needle projections 4 and the mold center piece 7 preventing the needle projections 4 from directly contacting the mold center piece 7. Consequently, the liner 6 is positioned all along the inner surface of the shell 1 against the mold center piece 7, or else it is positioned against the mold center piece 7 only in the regions corresponding to the needle projections 4. Since a liner 6 provided all along the inside of the shell 1 and the midsole 9 is sewn into a single piece shaped to cover the foot, it is easy to temporarily attach it to the mold center piece 7 for molding.

Any sheet material providing cushioning and ventilation can be used for the liner 6 attached inside the shell base 1B. In experiments performed by the inventor, continuously frothed light urethane foam with cloth liners attached to both surfaces was found to be optimum. Urethane foam with a thickness of 1 to 2.5 mm is used to provide sufficient cushioning, a relatively durable cloth which is difficult to tear and has a long lifetime is used for the liner on the inside surface contacting the foot, and a thin relatively large weave cloth is used for the liner in contact with the shell 1.

The urethane foam liner 6 with cloth liners attached to both sides has the features that synthetic resin for forming the shell base 1B is prevented from filling holes in the porous urethane foam, and when the mold is closed ready for injection, the large weave cloth allows the needle projections 4 to smoothly pierce the liner for reliable support.

The shoes shown in FIG. 4 are manufactured in the following manner. The mold is closed after attaching a liner 6 to the mold center piece 7, synthetic resin is injected into the closed mold 8 to form the shell base 1B with ventilation holes 3 and the midsole 9 as a single piece of synthetic resin, next the mold is opened and the single piece removed, the shell vamp 1A and cloth around the foot opening are sewn to the shell base 1B, and finally the sole 2 is bonded to complete the shoe.

Further, if necessary, a thin coating may be applied to outer surfaces. To prevent the coating from blocking the small ventilation holes 3, it is applied thinly.

What is claimed is:

1. A shoe comprising:

an upper shell formed of synthetic resin, having an upper opening adapted for receipt of a foot therethrough, and having a plurality of ventilation holes formed therein along a lower portion thereof, said ventilation holes each being located a vertical distance H below said upper opening and having a diameter D, and said shell having a thickness W at a location through which said holes are formed, said diameter D being such that $D < 30.2/H$, $D \leqq W$, and $D \leqq 1.5$, wherein said diameter D, said thickness W and said distance H are measured in millimeters.

2. A shoe as recited in claim 1, wherein said vertical distance H is equal for each of said plurality of ventilation holes.

* * * * *